US008696098B2

(12) United States Patent
Hays

(10) Patent No.: US 8,696,098 B2
(45) Date of Patent: Apr. 15, 2014

(54) PRINTHEAD HAVING PARTICLE CIRCULATION WITH SEPARATION

(75) Inventor: Andrew W. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 222 days.

(21) Appl. No.: 13/315,601

(22) Filed: Dec. 9, 2011

(65) Prior Publication Data

US 2013/0147886 A1 Jun. 13, 2013

(51) Int. Cl.
*B41J 2/175* (2006.01)
*B41J 2/18* (2006.01)

(52) U.S. Cl.
USPC ..... 347/88; 347/89

(58) Field of Classification Search
USPC ..... 347/88, 89
See application file for complete search history.

(56) References Cited

U.S. PATENT DOCUMENTS 4,814,786 A * 3/1989 Hoisington et al. ..... 347/88
5,386,224 A * 1/1995 Deur et al. ..... 347/7
5,453,159 A 9/1995 Markham
5,759,390 A 6/1998 Essop et al.
6,042,733 A 3/2000 Tucker
6,207,032 B1 3/2001 Buchanan
6,250,752 B1 6/2001 Tajima et al.
6,709,869 B2 3/2004 Mian et al.
7,004,577 B2 2/2006 Silverbrook
7,007,759 B2 3/2006 Harrington et al.
7,097,287 B2 8/2006 Nakao et al.
7,258,800 B1 8/2007 Herbst
7,607,766 B2 10/2009 Steiner
7,801,465 B2 9/2010 Thompson et al.
7,901,063 B2 3/2011 Wouters et al.
8,024,968 B2 9/2011 Sabanovic et al.
2001/0001060 A1 5/2001 Kellogg et al.
2005/0269557 A1 12/2005 Perrin et al.
2009/0035023 A1 2/2009 Thompson et al.
2010/0039460 A1 2/2010 Delueg
2010/0289857 A1 11/2010 Bennett

* cited by examiner

*Primary Examiner* — Matthew Luu
*Assistant Examiner* — Alexander D Shenderov
(74) *Attorney, Agent, or Firm* — Maginot, Moore & Beck, LLP

(57) ABSTRACT

A printhead having a circulation device to create a directed flow of ink and a separator to divert particulate matter, which can be present in the ink, to a location where the particulate matter falls out of the directed flow. The circulation device can include a heater configured to provide the directed flow of ink and the separator can include a divider to provide a location for particulate matter to be separated and screened from the ink and a bin to catch particulate matter falling from the ink during circulation.

17 Claims, 7 Drawing Sheets

PRINTHEAD HAVING PARTICLE CIRCULATION WITH SEPARATION

TECHNICAL FIELD

This disclosure relates generally to an inkjet printer having one or more printheads, and more particularly, to ink reservoirs in inkjet printers.

BACKGROUND

Inkjet printers have printheads that operate a plurality of inkjets that eject liquid ink onto an image receiving member. The ink may be stored in reservoirs located within cartridges installed in the printer. Such ink may be aqueous ink or an ink emulsion. Other inkjet printers receive ink in a solid form and then melt the solid ink to generate liquid ink for ejection onto the image receiving member. In these solid ink printers, the solid ink can be provided in the form of pellets, ink sticks, granules, pastilles, or other shapes. The solid ink is typically placed in an ink loader and delivered through a feed chute or channel to a melting device that melts the ink. The melted ink is then collected in a reservoir and supplied to one or more printheads through a conduit or the like. In other inkjet printers, ink can be supplied in a gel form. The gel is also heated to a predetermined temperature to alter the viscosity of the ink so the ink is suitable for ejection by a printhead.

A typical inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller.

In an inkjet printhead, ink is stored in ink reservoirs that are external to the printheads and in ink reservoirs that are integrated within the printheads. Particles of dust or debris sometimes enter the reservoirs during manufacture of the reservoirs and/or printheads. These particles may be liberated by the flow of liquid ink within a reservoir and become suspended in the liquid ink. If the particles enter the inkjet stack of the printhead, they may clog the flow of ink to one or more inkjets. Consequently, some inkjets can become intermittent, meaning the inkjet may fire sometimes and not at others. Reducing the presence of particles in liquid ink before the ink reaches the inkjet stack of a printhead remains a desirable goal in inkjet printers.

SUMMARY

A printhead having a reservoir that reduces the presence of particles in a liquid ink has been developed. The printhead, for use in an imaging device, deposits a melted phase change ink on an image receiving member. The printhead includes at least one wall and a bottom wall coupled to the at least one wall, to enclose a volume for storage of the melted phase change ink. One of the at least one wall and the bottom wall includes an outlet to provide a flow of melted phase change ink external to the reservoir. A circulation device is configured to generate a current flow of the melted phase change ink within the volume to move particulate matter to a position of lower current velocity where the particulate matter falls out of the current flow. A plurality of ink drop generators, coupled to the outlet, emit drops of melted phase change ink on the image receiving member.

In another embodiment, a phase change ink reservoir has been constructed that helps reduce the presence of particles in the melted phase change ink supplied by the reservoir to a printhead. The phase change ink reservoir, configured to supply melted phase change ink to the printhead, includes at least one wall and a bottom wall coupled to the at least one wall, to enclose a volume for storage of the melted phase change ink. A circulation device is configured to generate a current flow of the melted phase change ink within the volume to move particulate matter to a position of lower current velocity where the particulate matter falls out of the current flow.

BRIEF DESCRIPTION OF THE DRAWINGS

The foregoing aspects and other features of a printhead, a phase change ink reservoir and an inkjet imaging system are explained in the following description, taken in connection with the accompanying drawings.

DETAILED DESCRIPTION

Figure 1:
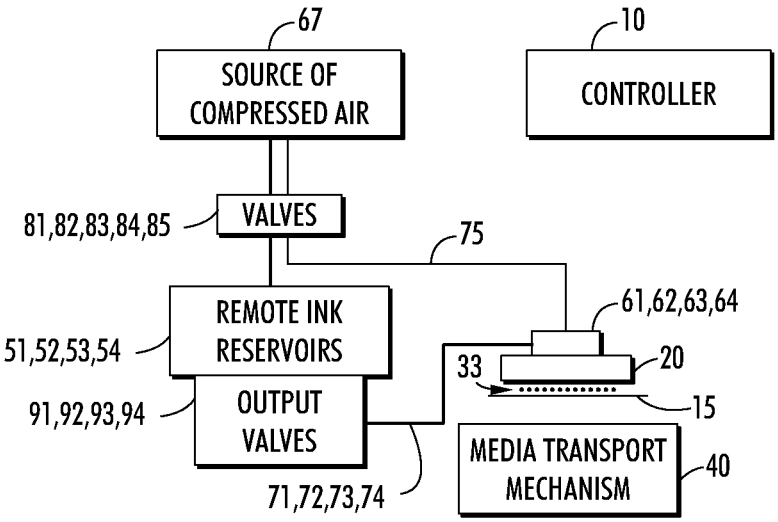
FIG. 1 is a schematic block diagram of an embodiment of an inkjet printing apparatus that includes on-board ink reservoirs.

For a general understanding of the present embodiments, reference is made to the drawings. In the drawings, like reference numerals have been used throughout to designate like elements.

As used herein, the term "inkjet imaging device" generally refers to a device for applying an ink image to print media. "Print media" can be a physical sheet of paper, plastic, or other suitable physical print media substrate for images, whether precut or web fed. The imaging device can include a variety of other components, such as finishers, paper feeders, and the like, and can be embodied as a copier, printer, or a multifunction machine. A "print job" or "document" is normally a set of related sheets, usually one or more collated copy sets copied from a set of original print job sheets or electronic document page images, from a particular user, or otherwise related. An image generally includes information in electronic form which is to be rendered on the print media by the marking engine and can include text, graphics, pictures, and the like.

Figure 2:
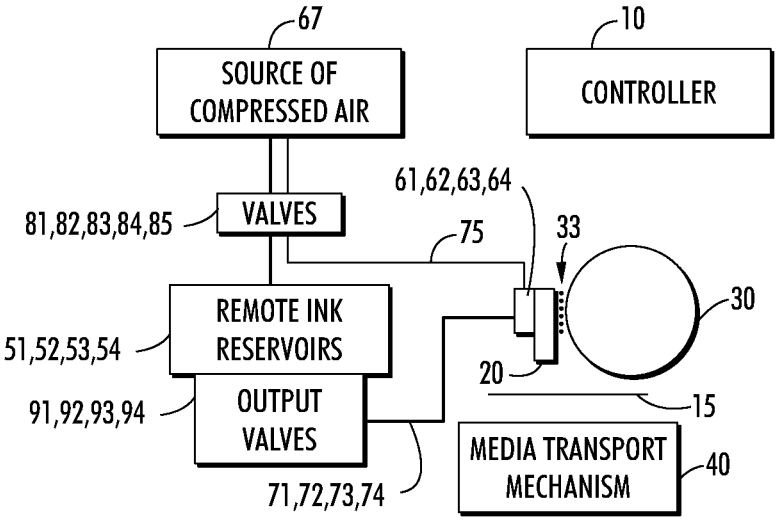
FIG. 2 is a schematic block diagram of another embodiment of an inkjet printing apparatus that includes on-board ink reservoirs.

FIGS. 1 and 2 are schematic block diagrams of an embodiment of an inkjet imaging device that includes a controller 10 and a printhead 20 that includes a plurality of inkjets that eject drops of ink 33 either directly onto a print output medium 15 or onto an intermediate transfer surface 30. A print media transport mechanism 40 moves print media relative to the printhead 20. The printhead 20 receives ink from a plurality of on-board ink reservoirs 61, 62, 63, 64, which are fluidly connected to the printhead 20. The on-board ink reservoirs 61-64 respectively receive ink from a plurality of remote ink containers 51, 52, 53, 54 via respective ink supply channels 71, 72, 73, 74.

Although not depicted in FIG. 1 or 2, the inkjet imaging device includes an ink delivery system for supplying ink to the remote ink containers 51-54. In one embodiment, the inkjet printing apparatus is a phase change ink imaging device. Accordingly, the ink delivery system comprises a phase change ink delivery system that has at least one source of at least one color of phase change ink in solid form. The phase change ink delivery system also includes a melting and control apparatus (not shown) for melting the solid form of the phase change ink into a liquid form and delivering the melted ink to the appropriate remote ink container.

The remote ink containers 51-54 are configured to supply melted phase change ink to the on-board ink reservoirs 61-64. In one embodiment, the remote ink containers 51-54 can be selectively pressurized, for example by compressed air, which is provided by a source of compressed air 67 via a plurality of valves 81, 82, 83, 84. The flow of ink from the remote containers 51-54 to the reservoirs 61-64 integrated within the printhead 20 can be pressurized by fluid or by gravity, for example. Output valves 91, 92, 93, 94 are provided to control the flow of ink to the on-board ink reservoirs 61-64.

The on-board ink reservoirs 61-64 can also be selectively pressurized, for example by selectively pressurizing the remote ink containers 51-54 and pressurizing an air channel 75 via a valve 85. Alternatively, the ink supply channels 71-74 can be closed, for example by closing the output valves 91-94, and pressurizing the air channel 75. The on-board ink reservoirs 61-64 can be pressurized to perform cleaning or purging operations on the printhead 20, for example. The on-board ink reservoirs 61-64 and the remote ink containers 51-54 can be configured and heated to store melted solid ink. The ink supply channels 71-74 and the air channel 75 can also be heated.

The on-board ink reservoirs 61-64 are vented to atmosphere during normal printing operation, for example by controlling the valve 85 to vent the air channel 75 to atmosphere. The on-board ink reservoirs 61-64 can also be vented to atmosphere during non-pressurizing transfer of ink from the remote ink containers 51-54 (i.e., when ink is transferred without pressurizing the on-board ink reservoirs 61-64).

FIG. 2 is a schematic block diagram of an embodiment of an inkjet imaging device that is similar to the embodiment of FIG. 1, and includes a transfer drum 30 for receiving the drops ejected by the printhead 20. A print media transport mechanism 40 engages print media 15 against the transfer drum 30 to cause the image printed on the transfer drum to be transferred to the print media 15.

Figure 3:
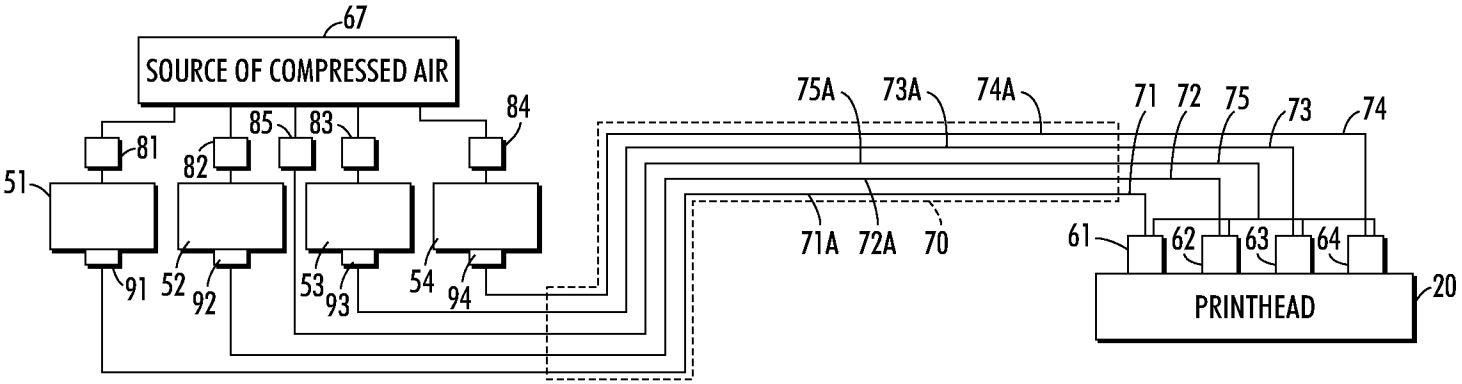
FIG. 3 is a schematic block diagram of an embodiment of ink delivery components of the inkjet printing apparatus of FIGS. 1 and 2.

As schematically depicted in FIG. 3, a portion of the ink supply channels 71-74 and the air channel 75 can be implemented as conduits 71A, 72A, 73A, 74A, 75A in a multi-conduit cable 70. These conduits are heated in embodiments of a solid ink inkjet imaging device to maintain the melted ink at a temperature that enables the ink to flow reservoirs in the printhead.

Figure 4:
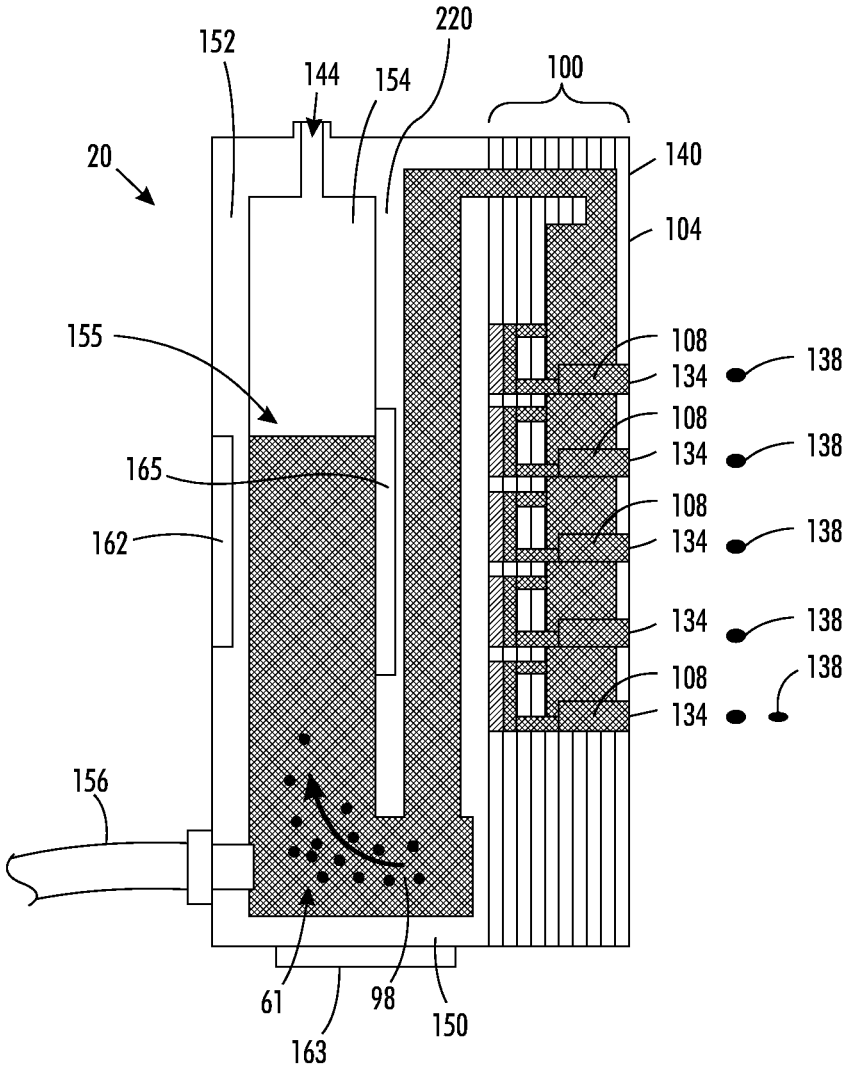
FIG. 4 is a simplified side cross-sectional view of one embodiment of a printhead including a supply reservoir and a heated reservoir of ink.

FIG. 4 illustrates a cross-sectional view of the printhead 20 and a single ink reservoir 61. Once liquid ink reaches the printhead via an ink supply channel, the liquid ink is collected in the on-board reservoir 61. The on-board reservoir is configured for fluid communication of the ink to a jet stack 100 that includes a plurality of inkjets for ejecting the ink onto print media (FIG. 1) or an intermediate transfer member, such as transfer drum 30 (FIG. 2).

FIG. 4 shows an embodiment of the printhead 20 that includes at least one on-board reservoir 61. An outlet 98 fluidly connects the reservoir 61 to the jetstack 100. The jet stack 100 can be formed in many ways, but in this example, the inkjet stack is formed of multiple laminated sheets or plates, such as stainless steel plates and polymer layers. The plates and layers of the jet stack 100 are stacked in face-to-face registration with one another and then brazed or otherwise adhered together to form a mechanically unitary and operational inkjet stack.

Cavities etched into each plate align to form channels and passageways that define the inkjets for the printhead. Larger cavities align to form larger passageways that run the length of the jet stack. These larger passageways are ink manifolds 104 arranged to supply ink to a plurality of inkjets 108. A plurality of apertures 134, each one being associated with a respective inkjet and formed in the inkjet stack aperture plate 140, eject ink drops 138.

In one embodiment, a negative pressure, or vacuum, can be applied to the ink in the on-board printhead reservoir 61 using, for example, a pressure source, such as a vacuum generator, through an opening or vent 144 in the on-board reservoir 61. The vent 144 through which the negative pressure is introduced into the on-board printhead reservoir 61 can be the same vent through which positive pressure is introduced for purging operations. Accordingly, the pressure source 67 can be a bi-directional pressure source, vacuum source, or air pump that is configured to supply both positive and negative pressure to the on-board printhead reservoir 61. Separate pressure sources, however, can be used to introduce the positive and negative pressures into the on-board printhead reservoir.

The reservoir 61 of the printhead 20 further includes a bottom wall 150 coupled to at least one wall 152 cooperating with additional walls to enclose a volume 154 adapted to store melted phase change ink 155. The melted phase change ink 155 can be supplied from one of the previously described remote ink reservoirs, which is remotely separated from the reservoir 154 but fluidly coupled to the reservoir with flexible tubing or other conduit 156.

Figure 5:
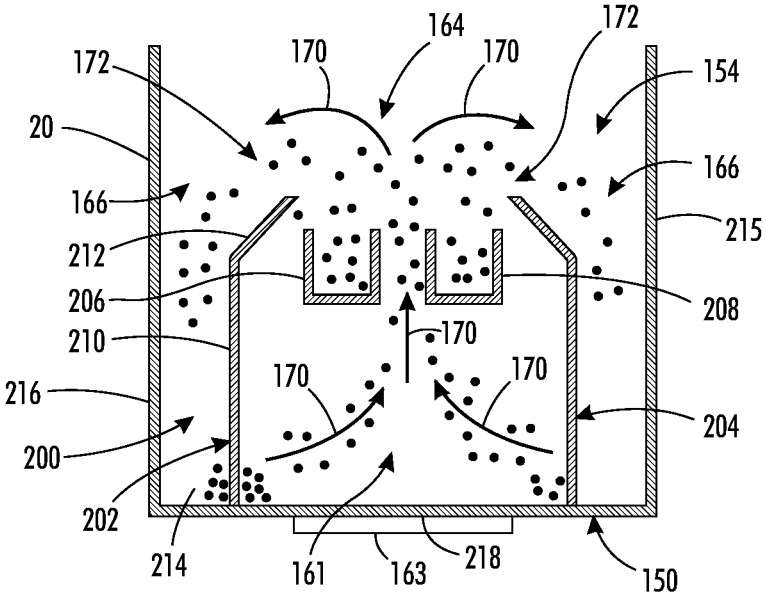
FIG. 5 is a simplified partial front view of one embodiment of a printhead including a heated reservoir having a circulation device and a separator.

A heater 162 is disposed adjacent the wall 152 that partially defines the volume 154. The heater 162 provides heat of a sufficiently elevated temperature to maintain the liquid state of the phase change ink held in the volume 154. The printhead 20 also includes a circulation device 163 as schematically shown in FIG. 4. The circulation device 163 is configured to generate a current flow within the volume of ink to move the ink in a flow path as illustrated in FIG. 5. The circulation device 163 produces an ink flow path or ink circulation in the volume 154 from a lower portion 161, to a higher portion 164 and to one of the side portions 166, the direction of which is shown by arrows 170. An ink circulation device 165 can also be located at a front wall 220. The ink circulation device 163 and the ink circulation device 165 can both be used at the same time or one or the other can provided. The heater 165 can also be located at the wall closer to the jetstack. The devices 163 and 165 can be generally located within a middle portion of the walls upon which located and the size can either be less than the wall where located or can include the entire wall. Additionally, the devices can be attached to a surface of the wall or can be embedded within a cavity existing in a wall.

Even though ink can be filtered by a filter (not shown) at a variety of points along the ink flow path from the remote reservoir to the inkjets 108, particles that either already exist in the reservoir 154, that are small enough to pass through a filter, or that are generated in the freeze/thaw cycle of the ink, can flow into the inkjet stack. Such particles can potentially cause jetting problems, such as missing or sputtering jets, which can produce image quality artifacts, and can block an inkjet such that no ink can be ejected from the inkjet onto the media. The circulator 163 not only moves the ink in the reservoir but also moves a number of particles 172 with the circulating ink. This circulating ink transports the particles 172 to low flow areas where they are less likely to be drawn into the inkjet stack. In some embodiments, the circulation device 163 actively initiates ink flow by applying a force to drive the flow, such as a stream of bubbles. The stream of bubbles can be produced by a localized heater on a wall of the reservoir 154 that causes water in the ink to bubble. Water in the ink can include a submerged droplet of water immiscible with the ink such, as solid phase change ink, or it can include water that is a primary component of an aqueous based ink. In another embodiment, an active pump can be used to induce ink circulation by pumping air to form rising bubble or by pumping fluid to create flow. In other embodiments, the circulation device can passively initiate ink flow with a convective current produced by temperature gradient in the liquid ink. Such a temperature gradient can be produced by the heater 163. The flow is established such that highest velocities are present near the outlet 98 of the reservoir (FIG. 4) to move particles away from this region of reservoir egress to lower velocity regions where the particles can settle out.

A region of lower velocity allows larger particles to sediment out. In one embodiment, local heating provided by the heater 163 provides comparatively rapid, localized rising of the ink toward the portion 164 and then providing a larger area cold surface that causes a wider, "downdraft" area toward the portions 166 and subsequently to areas of lower flow velocities. A rapid upward flow is naturally achieved with a bubble stream as the buoyant force of the bubbles locally act on the upward moving ink but not on the downward ink as there are no downward moving bubbles.

A separator 200, positioned within the volume 154, can include a first divider 202 and a second divider 204. The first divider 202 includes a generally vertical portion 210 and a generally angled portion 212 coupled to and being nonplanar with the generally vertical portion 210. The second divider 204 is similarly formed and is located closer to a side wall 215. The divider 202 partitions the volume 154 into a first area 214 defined to collect the particulate matter that falls out of the current and is trapped between the divider 202 and a side wall 216 of the reservoir 61. The other side of the divider generally defines the previously described area 161 where ink flows generally unobstructed. The generally vertical portion 210 is coupled to a bottom wall 150 of the reservoir 61 as well as to wall 152 of FIG. 4 and to a front wall 220.

Figure 6:
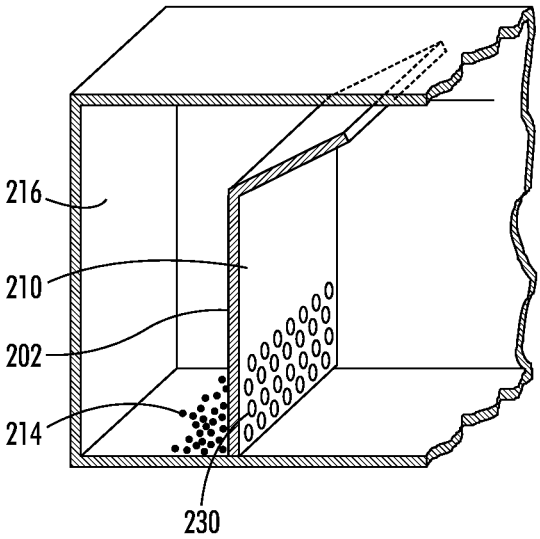
FIG. 6 is a simplified partial front view of one side of a heated reservoir having a diverter.

As seen in FIG. 6, separation can occur between the particles and the ink by providing a screen or filter 230 in the divider 202, as well as the divider 204 (not shown). Separation of undesirable particles from the ink is provided by the screen 230 since the main convective flow of ink passes through the screen and the screened particles remain at the first area 214 providing clean ink at the screen output. Loading over time is not a large concern because the amount of particles in the reservoir is generally low.

While the dividers 202 and 204 are illustrated to include a generally vertical portion and a second portion angled with respect to the generally vertical portion, the described portions need not include such a configuration as long as the dividers provide an area where the unwanted particles can be collected and the flow of circulating ink is substantially unimpeded. For instance, the angled portion 212 can be eliminated entirely and the generally vertical portion can be angled with respect to a sidewall to provide the collection area 214.

The separator 200 can further include a first bin 206 and a second bin 208. Each of the first bin 206 and the second bin 208 are located a distance from and unconnected to the bottom wall, but extend from the front wall 220 to the back wall 152. Each bin defines a collection area bin adjacent to the collection areas defined by the dividers so that the circulating particles in the paths of the arrows 170 can be captured by a bin and be removed from the circulating ink. While two bins are illustrated, the separator can include any number of bins, including zero, where collection of particles occurs in the areas defined by one or more of the dividers. Separation in the sedimentation bins 206 and 208 from the main convective flow and the particles being screened out at the screen output 230 can provide a substantially clean ink.

Figure 7:
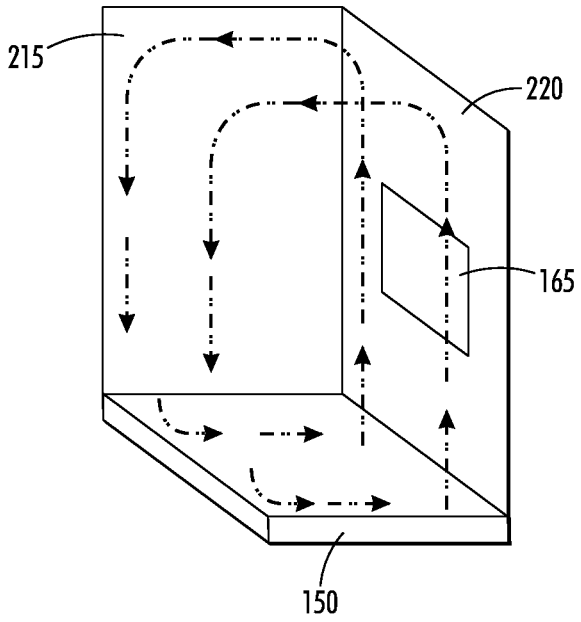
FIG. 7 is a simplified partial perspective view of a printhead reservoir having a circulation device located at a front wall.

FIG. 7 illustrates a schematic view of the circulation device 165 that has been configured to provide one desired ink flow. Particle circulation follows a path upwards along the side of the reservoir 61 that is hot, in this case the front wall 220, across the top wall, downward along the cool side or the back wall 152 (not shown), and then back to the starting point at the bottom of the hot side 220. To provide a directed flow for instance, the heater can be formed in the shape of a rectangle smaller than the front wall to which the heater is coupled such that the temperature provided gradually increases from the bottom wall, toward the top of the volume, and out towards the back wall and side walls. Thus, a printhead reservoir and/or a remote ink reservoir can be configured to include a circulation device with low cost. Such a device can be effective during periods of time when the printhead is idle and is transparent to the customer.

Since the thermal conductivity of the ink is low, the transfer of heat into the volume of water is slow and most of the bubble generation can be found near the contact point between the water droplet and bottom wall 150 of the reservoir 61, which is typically aluminum. Water can precipitate in hot ink and the resulting production of steam bubbles is generally well behaved for water in 115° C. ink. For instance, steam bubbles generated by water submerged in molten solid ink, either as a macroscopic droplet at the bottom of the pool or as water absorbed in the microscopic structure of an aluminum surface, can appear. Higher temperatures can cause rapid vaporization of the water, and consequently the temperature of the heater 163 or heater 165 should be selected with some accuracy. Also, the water needs to be managed so as to not be drawn into the inkjet stack where the water bubbles could produce missing jets.

Figure 8A:
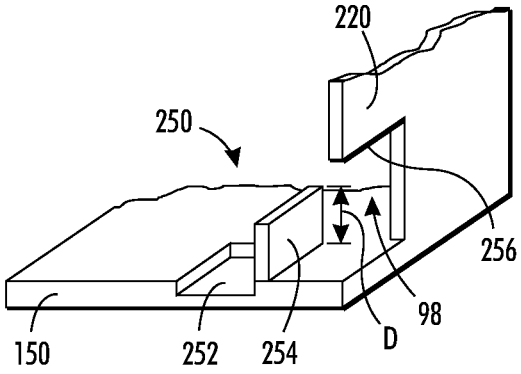
FIGS. 8A and 8B illustrate simplified views of a first trap and a second trap.
Figure 8B:
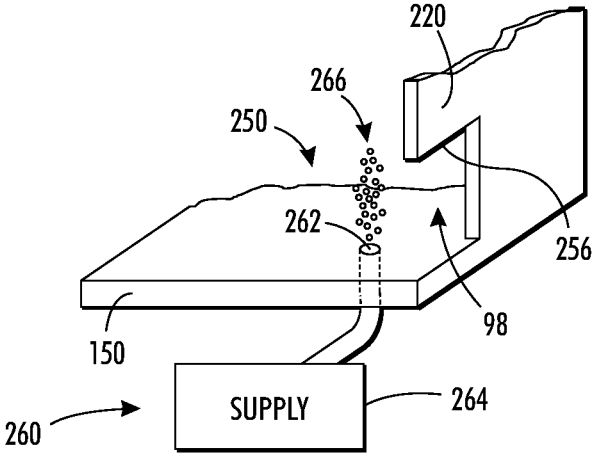

To substantially alleviate the introduction of water into the jetstack, the printhead can include a water droplet trap 250 located at the bottom wall 150. The bottom wall 150 includes a recess or depression 252 including a wall 254 extending from the bottom wall 150 and spaced a distance from the outlet 98. The wall 254 extends from the bottom wall a distance D, such that a top of the wall 254 does not extend to a top portion 256 of the outlet 98. The distance D provides for trapping a water droplet on one side of the wall, but does not substantially impede the flow of ink through the outlet 98. If, however, the trap 250 is sufficiently spaced from the outlet 98, then the selection of the height D of wall 254 becomes less significant. As illustrated in FIG. 8B a second trap or capillary structure 260 can also be used to alleviate introduction of water into the jetstack. The capillary device 260 can include a single small diameter orifice 262 at the bottom wall 150. The capillary device 260 is coupled to a supply of steam or water 264 to provide a force to drive steam bubbles 266 up from the orifice 262 and away from the outlet 98. Either one or both of the trap 250 or device 260 can be included.

Figure 9:
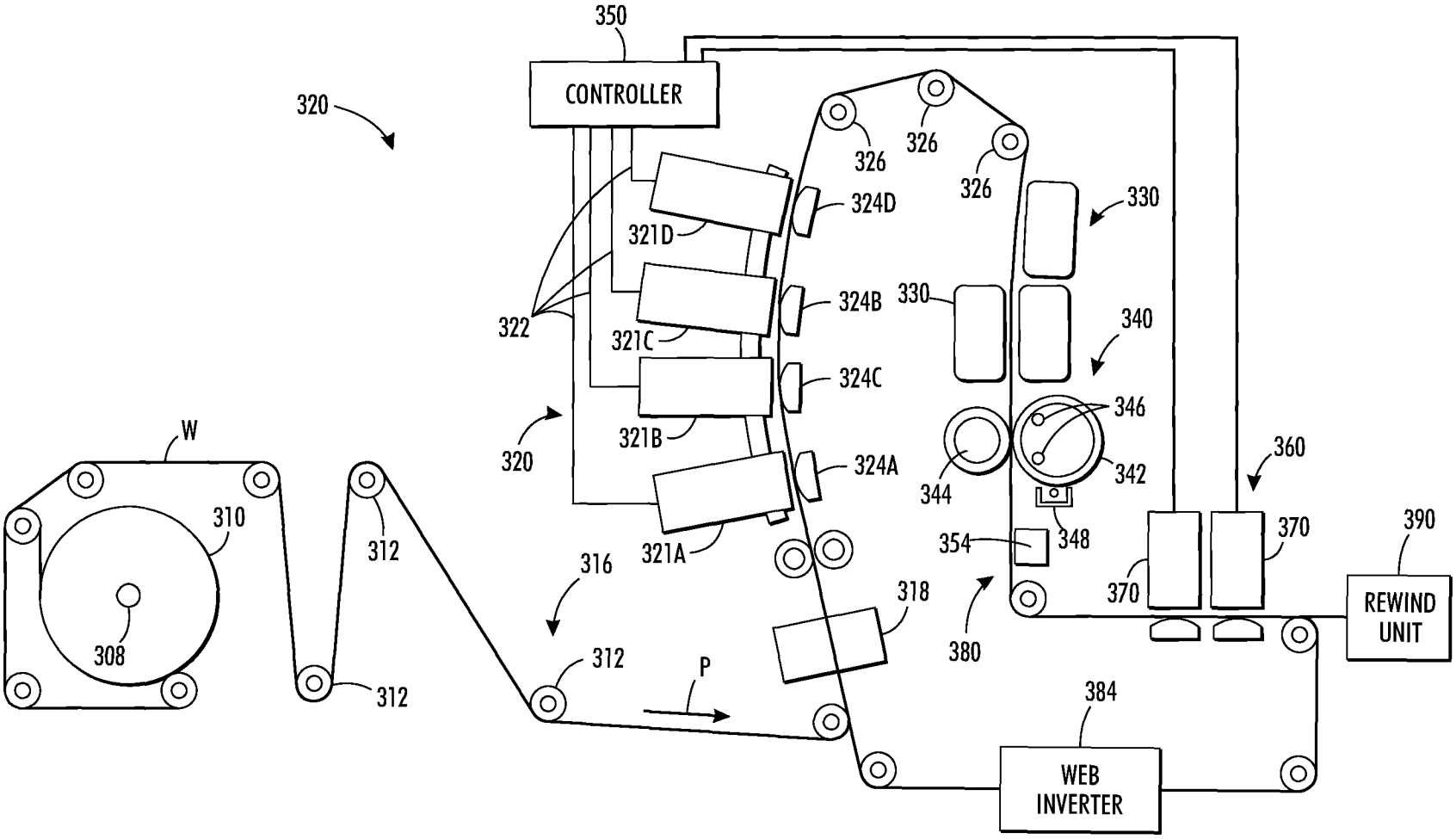
FIG. 9 PRIOR ART
FIG. 9 is a schematic view of a prior art inkjet imaging system that ejects ink onto a continuous web of media as the media moves past the printheads in the system.

Referring to FIG. 9, a prior art inkjet imaging system 320 is shown. For the purposes of this disclosure, the imaging apparatus is in the form of an inkjet printer that employs one or more inkjet printheads and an associated solid ink supply. However, the phase change ink reservoir that supplies melted phase change ink and the printhead described herein are applicable to any of a variety of other inkjet imaging devices that use inkjets to eject one or more colorants onto media. The imaging apparatus includes a print engine to process the image data before generating the control signals for the inkjet ejectors. The colorant can be ink, or any suitable substance that includes one or more dyes or pigments and that can be applied to the selected media. The colorant can be black, or any other desired color, and a given imaging apparatus can be capable of applying a plurality of distinct colorants to the media. The media can include any of a variety of substrates, including plain paper, coated paper, glossy paper, or transparencies, among others, and the media can be available in sheets, rolls, or another physical formats.

FIG. 9 is a simplified schematic view of a direct-to-sheet, continuous-media, phase-change inkjet imaging system 320, that can include the phase change ink reservoir to supply melted phase change ink and the printhead discussed above. A media supply and handling system is configured to supply a long (i.e., substantially continuous) web of media W of "substrate" (paper, plastic, or other printable material) from a media source, such as spool of media 310 mounted on a web roller 308. For simplex printing, the printer is comprised of feed roller 308, media conditioner 316, printing station 320, printed web conditioner 380, coating station 360, and rewind unit 390. For duplex operations, a web inverter 384 is used to flip the web over to present a second side of the media to the printing station 320, printed web conditioner 380, and coating station 360 before being taken up by the rewind unit 390. In the simplex operation, the media source 310 has a width that substantially covers the width of the rollers over which the media travels through the printer. In duplex operation, the media source is approximately one-half of the roller widths as the web travels over one-half of the rollers in the printing station 320, printed web conditioner 380, and coating station 360 before being flipped by the inverter 384 and laterally displaced by a distance that enables the web to travel over the other half of the rollers opposite the printing station 320, printed web conditioner 380, and coating station 360 for the printing, conditioning, and coating, if necessary, of the reverse side of the web. The rewind unit 390 is configured to wind the web onto a roller for removal from the printer and subsequent processing.

The media can be unwound from the source 310 as needed and propelled by a variety of motors, not shown, rotating one or more rollers. The media conditioner includes rollers 312 and a pre-heater 318. The media is transported through a printing station 320 that includes a series of printhead modules 321A, 321B, 321C, and 321D, each printhead module effectively extending across the width of the media and being able to place ink directly (i.e., without use of an intermediate or offset member) onto the moving media. As is generally familiar, each of the printheads can eject a single color of ink, one for each of the colors typically used in color printing, namely, cyan, magenta, yellow, and black (CMYK). The controller 350 of the printer receives velocity data from encoders mounted proximately to rollers positioned on either side of the portion of the path opposite the four printheads to compute the position of the web as moves past the printheads. The controller 350 uses these data to generate timing signals for actuating the inkjet ejectors in the printheads to enable the four colors to be ejected with a reliable degree of accuracy for registration of the differently color patterns to form four primary-color images on the media. The inkjet ejectors actuated by the firing signals corresponds to image data processed by the controller 350. The image data can be transmitted to the printer, generated by a scanner (not shown) that is a component of the printer, or otherwise generated and delivered to the printer. In various possible embodiments, a printhead module for each primary color can include one or more printheads; multiple printheads in a module can be formed into a single row or multiple row array; printheads of a multiple row array can be staggered; a printhead can print more than one color; or the printheads or portions thereof can be mounted movably in a direction transverse to the process direction P, such as for spot-color applications and the like.

The printer can use "phase-change ink," by which is meant that the ink is substantially solid at room temperature and substantially liquid when heated to a phase change ink melting temperature for jetting onto the imaging receiving surface. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink can also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each printhead module is a backing member 324A-324D, typically in the form of a bar or roll, which is arranged substantially opposite the printhead on the back side of the media. Each backing member is used to position the media at a predetermined distance from the printhead opposite the backing member. Each backing member can be configured to emit thermal energy to heat the media to a predetermined temperature which, in one practical embodiment, is in a range of about 40° C. to about 60° C. The various backer members can be controlled individually or collectively. The pre-heater 318, the printheads, backing members 324 (if heated), as well as the surrounding air combine to maintain the media along the portion of the path opposite the printing station 320 in a predetermined temperature range of about 40° C. to 70° C.

As the partially-imaged media moves to receive inks of various colors from the printheads of the printing station 320, the temperature of the media is maintained within a given range. Ink is ejected from the printheads at a temperature typically significantly higher than the receiving media temperature. Consequently, the ink heats the media. Therefore other temperature regulating devices are employed in various embodiments to maintain the media temperature within a predetermined range. Following the printing zone 320 along the media path are one or more "mid-heaters" 330. A mid-heater 330 can use contact, radiant, conductive, and/or convective heat to control a temperature of the media. The mid-heater 330 brings the ink placed on the media to a temperature suitable for desired properties when the ink on the media is sent through the spreader 340. In one embodiment, a useful range for a target temperature for the mid-heater is about 35° C. to about 80° C.

Following the mid-heaters 330, a fixing assembly or spreader 340 is configured to apply heat and/or pressure to the media to fix the images to the media. The fixing assembly can include any suitable device or apparatus for fixing images to the media including heated or unheated pressure rollers, radiant heaters, heat lamps, and the like.

The spreader 340 can also include a cleaning/oiling station 348 associated with image-side roller 342. The station 348 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page.

The coating station 360 applies a clear ink to the printed media. This clear ink helps protect the printed media from smearing or other environmental degradation following removal from the printer. The overlay of clear ink acts as a sacrificial layer of ink that can be smeared and/or offset during handling without affecting the appearance of the image underneath. The coating station 360 applies the clear ink with either a roller or a printhead 370 ejecting the clear ink in a pattern. Clear ink for the purposes of this disclosure is functionally defined as a substantially clear overcoat ink that has minimal impact on the final printed color, regardless of whether or not the ink is devoid of all colorant.

Following passage through the spreader 340 the printed media can either be wound onto a roller for removal from the system (simplex printing) or directed to the web inverter 384 for inversion and displacement to another section of the rollers for a second pass by the printheads, mid-heaters, spreader, and coating station. The duplex printed material can then be wound onto a roller for removal from the system by rewind unit 390. Alternatively, the media can be directed to other processing stations that perform tasks such as cutting, binding, collating, and/or stapling the media or the like.

Operation and control of the various subsystems, components and functions of the device 320 are performed with the aid of the controller 350. The controller 350 can be implemented with general or specialized programmable processors that execute programmed instructions. The instructions and data required to perform the programmed functions are typically stored in memory associated with the processors or controllers. The processors, their memories, and interface circuitry configure the controllers and/or print engine to perform the functions described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The imaging system 320 can also include an optical imaging system 354 that is configured in a manner similar to that described above for the imaging of the printed web. The optical imaging system is configured to detect, for example, the presence, intensity, and/or location of ink drops jetted onto the receiving member by the inkjets of the printhead assembly.

It will be appreciated that several of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A phase change ink reservoir configured to supply melted phase change ink to a printhead comprising:

at least one wall;

a bottom wall coupled to the at least one wall, to enclose a volume for storage of melted phase change ink;

a circulation device configured to generate a current flow of the melted phase change ink within the volume; and a divider having a first side and a second side, the divider being oriented within the volume to enable the current flow of the melted phase change ink to move along the first side of the divider in a first direction and to move along the second side of the divider in a second direction, the first direction being opposite the second direction, the movement of the current flow being slower in the second direction than the movement of the current flow in the first direction to enable particulate matter to fall out of the current flow and the divider stops the particulate matter that falls out of the current flow from returning to the current flow along the first side of the divider.

2. The phase change ink reservoir of claim 1 wherein the circulation device is disposed along one of the at least one wall and the bottom wall and includes a temperature change device.

3. The phase change ink reservoir of claim 2 wherein the temperature change device includes a heater.

4. The phase change ink reservoir of claim 3 wherein the heater includes a shape defined to provide a convective current flow of melted phase change ink from the bottom wall, to a location above the bottom wall, and to a location adjacent to the at least one wall.

5. The phase change ink reservoir of claim 1 wherein the at least one wall includes a plurality of walls.

6. The phase change ink reservoir of claim 5 wherein the divider connects one of the plurality of walls to another of the plurality of walls and is coupled to the bottom wall.

7. The phase change ink reservoir of claim 6 wherein the divider includes a generally vertical portion coupled to the bottom wall and a generally angled portion coupled to and being nonplanar with the generally vertical portion.

8. The phase change ink reservoir of claim 7 wherein the generally vertical portion of the divider includes a screen configured to enable the current flow to return to the first side of the divider without enabling the particulate to return to the first side of the divider.

9. The phase change ink reservoir of claim 8 wherein the separator includes a first bin disposed above the bottom wall and being unconnected thereto.

10. The phase change ink reservoir of claim 1 wherein one of the at least one wall and the bottom wall includes an outlet to provide a flow of melted phase change ink external to the reservoir and includes a trap positioned adjacent to the outlet, the trap configured to reduce water present in the melted phase change ink from moving to a jetstack of the printhead.

11. A printhead for use in an imaging device to deposit a melted phase change ink on an image receiving member comprising:

at least one wall;

a bottom wall coupled to the at least one wall, to enclose a volume for storage of melted phase change ink, wherein one of the at least one wall and the bottom wall includes an outlet to provide a flow of melted phase change ink external to the reservoir;

a circulation device configured to generate a current flow of the melted phase change ink within the volume;

a divider having a first side and a second side, the divider being oriented within the volume to enable the current flow of the melted phase change ink to move along the first side of the divider in a first direction and to move along the second side of the divider in a second direction, the first direction being opposite the second direction, the movement of the current flow being slower in the second direction than the movement of the current flow in the first direction to enable particulate matter to fall out of the current flow and the divider stops the particulate matter that falls out of the current flow from returning to the current flow along the first side of the divider; and a plurality of ink drop generators, coupled to the outlet, to emit drops of melted phase change ink on the image receiving member.

12. The printhead of claim 11 further comprising a trap positioned adjacent to the outlet, the trap configured to reduce water present in the melted phase change ink from moving to the plurality of ink drop generators.

13. The printhead of claim 11 wherein the circulation device is disposed along one of the at least one wall and the bottom wall and includes a temperature change device.

14. The printhead of claim 13 wherein the temperature change device includes a shape defined to provide a convective current flow of melted phase change ink from the bottom wall, to a location above the bottom wall, and to a location adjacent to the at least one wall.

15. The printhead of claim 14 wherein the at least one wall includes a plurality of walls and the divider connects one of the plurality of walls to another of the plurality of walls and is coupled to the bottom wall.

16. The printhead of claim 15 wherein the divider includes a generally vertical portion coupled to the bottom wall and a generally angled portion coupled to and being nonplanar with the generally vertical portion, wherein the generally vertical portion includes a screen.

17. The printhead of claim 16 wherein the separator includes a bin disposed above the bottom wall and being unconnected thereto.

* * * * *